United States Patent [19]

Horn

[11] 4,156,294

[45] May 29, 1979

[54] BASEBALL UNDERGARMENT

[76] Inventor: Spencer C. Horn, 301 E. 7th St., Cushing, Okla. 74023

[21] Appl. No.: 810,172

[22] Filed: Jun. 27, 1977

[51] Int. Cl.[2] ..... A41B 9/00

[52] U.S. Cl. ..... 2/400; 2/239; 2/409

[58] Field of Search ..... 2/400, 409, 2, 22, 23, 2/24, 239; 128/159, 132; D2/331-341

[56] References Cited

U.S. PATENT DOCUMENTS

| | | | |
|---|---|---|---|
| 242,829 | 12/1976 | Connelly | D2/341 |
| 2,179,631 | 11/1939 | Holder | 2/22 |
| 3,670,339 | 6/1972 | Cooper et al. | 2/22 |
| 3,787,892 | 1/1974 | Quinn | 2/409 X |
| 3,788,314 | 1/1974 | Noreen | 2/2 X |
| 4,035,844 | 7/1977 | Atack et al. | 2/22 X |

*Primary Examiner*—H. Hampton Hunter
*Attorney, Agent, or Firm*—Robert M. Hessin

[57] ABSTRACT

An undergarment for coactive usage with the standard form of baseball uniform which unitarily includes the slide pads, supporter and cup structure, undersocks and ankle socks. The undergarment is unitarily formed to include all accessory lower body devices so that the garment can be donned in singular operation.

7 Claims, 4 Drawing Figures

BASEBALL UNDERGARMENT

BACKGROUND OF THE INVENTION

1. Field of the Invention

The invention relates to baseball uniform undergarments and, more particularly, but not by way of limitation, it relates to a unitary undergarment that includes multiple accouterments.

2. Description of the Prior Art

Prior forms of baseball undergarment have adhered to the relatively conventional concepts of plural individual items as each is donned separately for the particular uniform or protective function. Thus, it has been the practice heretofore to utilize an athletic supporter of particular form and size to include the protective groin cup, whereupon slide pads of individual nature or as may be joined by a front buckling belt were secured thereover. The undersock was then pulled on to the leg to extend well up over the knee while the uniform or ankle sock was next donned. Thereafter, the baseball pant would be turned inside out for insertion of the leg through the knee hole with downward folding of the undersock and ankle sock over the lower cuff thereof so that pulling on of the pants into their right-side out disposition would result in a secure and aesthetically popular knee cuff. Such knee cuff was then out of sight within the pants and, by individual adjustment desires, a very secure holding of the socks was obtained.

SUMMARY OF THE INVENTION

A baseball undergarment that is unitarily formed to include a lower body ventilative pant, sliding pads, groin support and cup structure, and undersocks with ankle socks.

Therefore, it is an object of the present invention to provide an improved baseball undergarment which unitarily embodies structure performing multiple protective and uniform functions.

It is also an object of the present invention to provide a baseball undergarment which is much easier to don, launder and care for while also offering attributes of ventilation and comfort.

Finally, it is an object of this invention to provide a single, unitarily formed undergarment providing all the functions of slide pads, baseball uniform socks, athletic supporter protection, and the like.

Other objects and advantages of the invention will be evident from the following detailed description when read in conjunction with the accompanying drawing which illustrates the invention.

DETAILED DESCRIPTION OF THE PREFERRED EMBODIMENT

Figure 1:
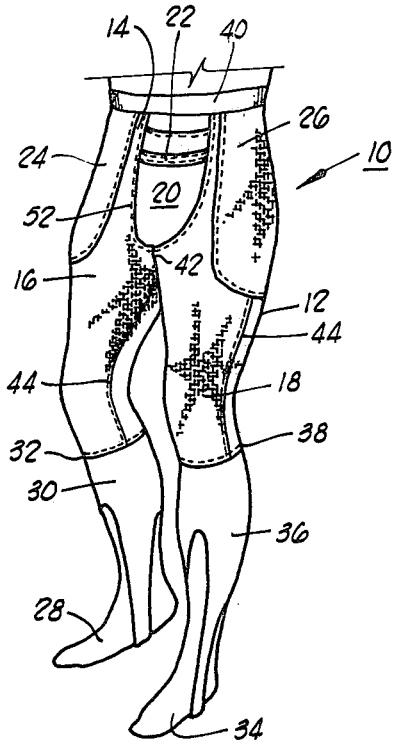
FIG. 1 is a first representation of the general form of the baseball undergarment as worn by a player.
Figure 2:
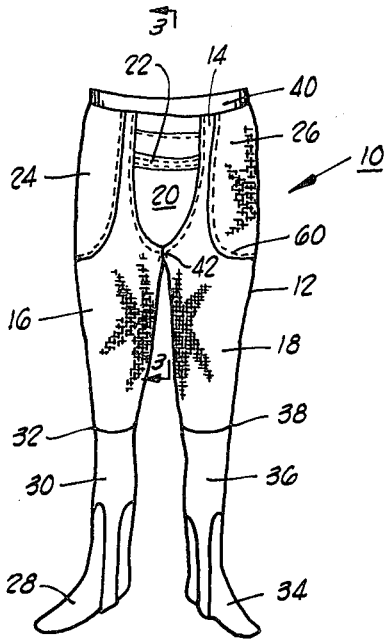
FIG. 2 is a similar view in elevation of the undergarment in its unworn attitude.

With reference to FIGS. 1 and 2, a unitary baseball undergarment 10 consists of underpants 12 of knee length and constructed in conventional manner to include a waist portion 14, right leg pant 16 and left leg pant 18. A supporter pocket 20 is then formed over the groin area and adapted for removable retention of protective cup structure, as will be further described below. A fastener opening 22 aids in retaining such protective cup. A right slide pad 24 and a left slide pad 26 are then integrally formed with the underpant waist portion 14 in their respective right pant 16 and left pant 18. A right undersock 28 is secured within a right ankle sock 30 at a right knee seam 32. In like manner, a left undersock 34 is disposed within a left ankle sock 36 and both are secured at the left knee seam 38.

Materials and needlework are of relatively conventional type as a wide elastic waist band 40 (e.g., 2 inches in width) is suitably stitched with underhemming to waist portion 14 of undergarment 10 to provide the necessary resilient grip to the body. In present design, the underpants 12 are made from elastic material known as Nylon spandex, and seamed in conventional manner by a french or overlapped seam 42 from the crotch up the front and the back to waist band 40. The respective pant legs 16 and 18 are further seamed up the inner and outer leg sides by side seams 44 (FIG. 1). In all seaming and padding structure, the present practice is to use one hundred percent polyester spun thread known as SYNTEL.

Figure 3:
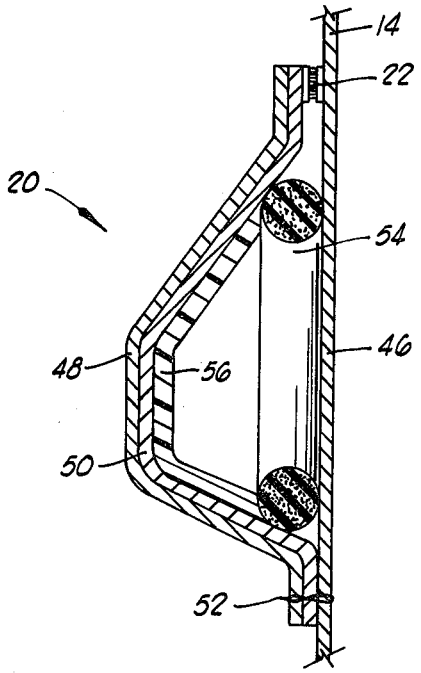
FIG. 3 is a section through lines 3—3 of FIG. 2 illustrating the supporter and cup section of the undergarment.

The supporter pocket 20, as shown in greater detail in FIG. 3, includes an inner panel 46 and two ply panels 48 and 50 as seamed within the front part of waist portion 14 by means of seam 52. The VELCRO closure strip 22 is then seamed across the top to enable secure retention of a protective cup consisting of a generally circular cushion portion 54 and a plastic cup portion 56. Thus, the VELCRO strip 22 may be opened for removal of the cup 56 thereby to enable laundering of the undergarment 10. The material of panels 46, 48 and 50 is in present design a Nylon tricot of selected weight and denier. Also, it may be desirable to include a two ply tricot panel for the inner panel 46 as well as the outer panels 48 and 50.

Figure 4:
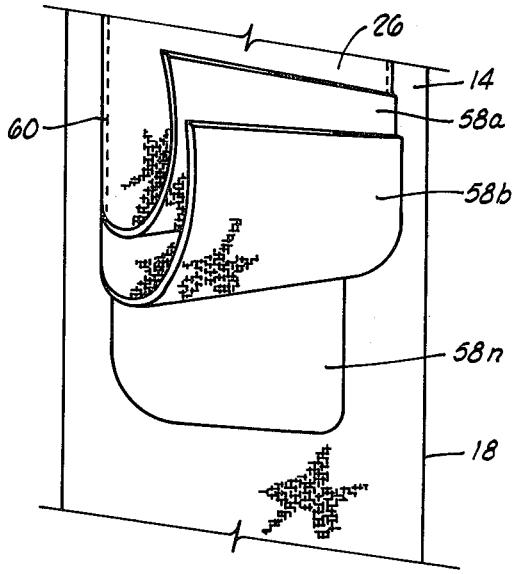
FIG. 4 is a plan view of a portion of the undergarment including the slide pad structure in layout representation.

As shown in FIG. 4, the slide pads are also formed of multiple thicknesses of Nylon tricot as sewn over the spandex underpant at proper hip location. Thus, in referring to the left hip pad 26, a multiple of pad panels 58*a*, 58*b* through 58*n* are stitched in overlay by means of a seam 60 to the mid portion 14 and adjoining left pant 18. Construction of the right slide pad 24 would be in like manner. The size and number of panels 58 are entirely within the skilled designer's selection, this depending upon the exigencies of application and the particular weight and consistency of the fabric utilized.

Referring again to FIGS. 1 and 2, the undersocks 28 and 34 may be the conventional cotton hose while the ankle socks 30 and 36 are the well-known type of uniform sock wherein the team colors and uniform motif are carried out. On the right leg, both socks 28 and 30 are secured at seam 32 by a double stitching which, when gathered in securement to the spandex fabric of right pant 16, provides a tight and secure fit to the body of the wearer. Left socks 34 and 36 are similarly double stitched at seam 38 to provide the proper form fit.

The foregoing discloses a novel form of baseball undergarment wherein optimum characteristics as to wearability, ventilation, ease of laundering and general maintenance have been availed of in order to provide a unique, form fitting baseball undergarment that provides secure underpinnings to the ball player. The undergarment offers equal or better protection, support and/or aesthetic appeal while being more compact and lighter weight with maximum benefit accruing relative to capabilities for shipping, storing and the like. By simple variation and selection of materials and initial patterning, the undergarment can be constructed to meet any criteria imposed by particular conditions of usage.

Changes may be made in the combination and arrangement of elements as heretofore set forth in the specification and shown in the drawing; it being understood that changes may be made in the embodiments disclosed without departing from the spirit and scope of the invention as defined in the following claims.

What is claimed is:

1. A baseball undergarment comprising:

knee length underpants of generally form fitting material and having at least a waist portion and right and left legs; and first and second slide pads each secured to a respective right and left side of said waist portion;

a supporter panel of plural plies of material secured in said front waist portion between said first and second slide pads;

means for enabling insertion of a solid protective cup between two of said plies of material;

first and second full foot undersocks of knee length;

first and second ankle socks of knee length each disposed to enclose a respective first and second undersock, said ankle socks being of the footless type but including a stirrup; and means stitching said first undersock and ankle sock and said second undersock and ankle sock to the knee area portion of said respective right and left legs.

2. A baseball undergarment as set forth in claim 1 wherein said first and second slide pads each include:

plural plies of resilient material placed in overlay and seamed to the respective side of said waist portion about their periphery.

3. A baseball undergarment as set forth in claim 2 wherein said plural plies are formed of nylon tricot.

4. A baseball undergarment as set forth in claim 1 wherein said knee length underpants are formed of two-way stretch material.

5. A baseball undergarment comprising:

knee length underpants of generally form fitting material and having at least a waist portion and right and left legs;

first and second full foot undersocks of knee length;

first and second ankle socks of knee length each disposed to enclose a respective first and second undersock; and means stitching said first undersock and ankle sock and said second undersock and ankle sock to a respective right and left legs.

6. A baseball undergarment as set forth in claim 5 which further includes:

first and second slide pads each secured to a respective right and left side of said waist portion.

7. A baseball undergarment as set forth in claim 6 wherein said slide pads each include:

plural plies of resilient material placed in overlay and seamed to the respective side of said waist portion about their periphery.

* * * * *